US005725422A

United States Patent [19]

Leweck

[11] Patent Number: 5,725,422

[45] Date of Patent: Mar. 10, 1998

[54] AUTO BODY BUFFING MACHINE WITH HANDLE ANGULARLY ADJUSTABLE TO DIFFERENT FIXED POSITIONS

[76] Inventor: Joseph F. Leweck, 1117 E. Main St., Santa Paula, Calif. 93060

[21] Appl. No.: 772,933

[22] Filed: Dec. 24, 1996

Related U.S. Application Data

[60] Provisional application No. 60/028,886, Oct. 17, 1996.

[51] Int. Cl.[6] ..... B24B 23/00

[52] U.S. Cl. ..... 451/359; 451/360; 16/114 R

[58] Field of Search ..... 451/359, 360; 16/114 R, DIG. 12; 408/241 R; 84/117.8, 489, 117.9, 117.7

[56] References Cited

U.S. PATENT DOCUMENTS

| | | | |
|---|---|---|---|
| 941,707 | 11/1909 | Gaines | 81/177.6 |
| 1,076,793 | 11/1913 | Seipel | 81/177.8 |
| 1,417,338 | 5/1922 | Lenahan | 81/177.8 |
| 5,231,727 | 8/1993 | Armbruster | 81/489 |
| 5,269,045 | 12/1993 | DeSeria et al. . | |
| 5,515,754 | 5/1996 | Elkins | 81/177.7 |

*Primary Examiner*—Robert A. Rose
*Assistant Examiner*—George Nguyen
*Attorney, Agent, or Firm*—Gene W. Arant

[57] ABSTRACT

An auto body buffing and grinding machine has a fixed handle with a trigger mechanism, a surface with threaded opening for attachment of an adjustable handle, and an adjustable handle that is quickly and easily attached, adjusted, or detached. The adjustable handle has two angularly adjustable mechanisms working in mutually perpendicular planes, each being secured by a hand operable nut. One attachment mechanism works by insertion from the outside of the threaded opening and then the tightening of its associated nut against the surface surrounding the opening. The other attachment mechanism works by securing parallel plates with roughened surfaces together, and includes a spring normally urging the roughened surfaces of the plates apart. The plates are rotatable by more than ninety degrees.

8 Claims, 6 Drawing Sheets

AUTO BODY BUFFING MACHINE WITH HANDLE ANGULARLY ADJUSTABLE TO DIFFERENT FIXED POSITIONS

This application claims the benefit of my Provisional patent application Ser. No. 60/028,886 filed Oct. 17, 1996.

BACKGROUND OF THE INVENTION

In automobile body shops there is a great deal of need to use buffing or grinding machines that can shape or smooth the metal surfaces. Such machines are in common usage. The typical machine has a housing from which a rotating drive shaft extends, and a grinder or buffing pad is then attached to the exposed end of the drive shaft. In the typical machine there is also a main handle that is fixedly attached to the housing. There is usually a trigger mechanism associated with the main handle.

In addition to the main handle, the typical machine also has an auxiliary handle that can be attached to the housing in either one of two positions. The housing has two threaded openings, one on the left side and one on the right side. The auxiliary handle includes a shaft having a threaded end that is threaded into a selected one of those openings, to attach the handle to the corresponding side of the machine. The operator then uses both hands, grasping the two handles simultaneously for applying pressure to the machine so that it can effectively perform the shaping or smoothing operation.

While such buffer/grinder machines can provide a good end result, the use of them is very labor-intensive. Many hours of holding the machine and pushing it against the metal surface is very tiring to the worker. There are also ergonomic problems, because the worker may have an excessive amount of repetitive strain upon the arm and wrist. This in turn can greatly reduce the efficiency of the work.

SUMMARY OF THE INVENTION

According to the present invention an automobile body buffer/grinder machine is provided with an auxiliary handle that is fully angularly adjustable to different positions. The handle has a hand grip that can be moved to any selected position of adjustment relative to the housing of the buffer/grinder, at any desired angle and in any desired rotational position relative to the housing. The hand grip can then be locked in its adjusted position. My invention also provides convenient hand-operated means for accomplishing the locking. Thus, the worker may conveniently choose whatever handle position will maximize his comfort and the efficiency of the buffing operation, and when the handle is locked can then apply the maximum amount of force to the workpiece with a minimum amount of physical strain on his body, and in particular his arm and wrist.

I prefer to accomplish the adjustment of the auxiliary handle in two separate steps, with the mechanism then being locked in place after each separate adjustment.

To accomplish the first step of adjustment, the adjustable handle includes an attachment shaft having a threaded forward end that is inserted into one of the threaded openings in the machine body. The attachment shaft is rotatable about its own axis relative to the machine body, and a separate hand-operated locking means is provided to lock the attachment shaft in its selected rotational position.

To accomplish the second step of adjustment, the presently preferred form of my invention provides an elongated hand grip that has a forward end pivotally connected to the rearward end of the attachment shaft. The hand grip is pivotable relative to the shaft in the plane of the shaft. A separate hand-operated locking means is provided to lock the hand grip in its selected position of rotation relative to the attachment shaft.

An advantage of the preferred form of my invention is that it provides a convenient retrofit to existing buffing/grinding machines, which already have a threaded opening in the housing to receive an auxiliary handle.

DRAWING SUMMARY

FIG. 1 is a top plan view of the machine in operative condition, and showing alternate locations of the adjustable handle in dotted lines;

FIG. 2 is a side elevation view on line 2—2 of FIG. 1;

FIG. 3 is a vertical cross-sectional view taken on the line 3—3 of FIG. 1;

FIG. 4 is a fragmentary cross-sectional view taken on the line 4—4 of FIG. 3;

FIGS. 5, 7, 9, and 11 show an auto body buffing machine having a fixed handle in accordance with the prior art, and also showing the operator in various different working positions to accomplish different parts of the work, all of the positions being uncomfortable due to the inflexibility of the machine; and FIGS. 6, 8, 10, and 12 show the corresponding working positions when using my invention with adjustable handle, in which the operator is able to more efficiently hold and apply force to the machine, but with a greatly reduced stress upon his own body, and particularly the arm and wrist.

DETAILED DESCRIPTION OF PREFERRED EMBODIMENT

Figures 1, 2:
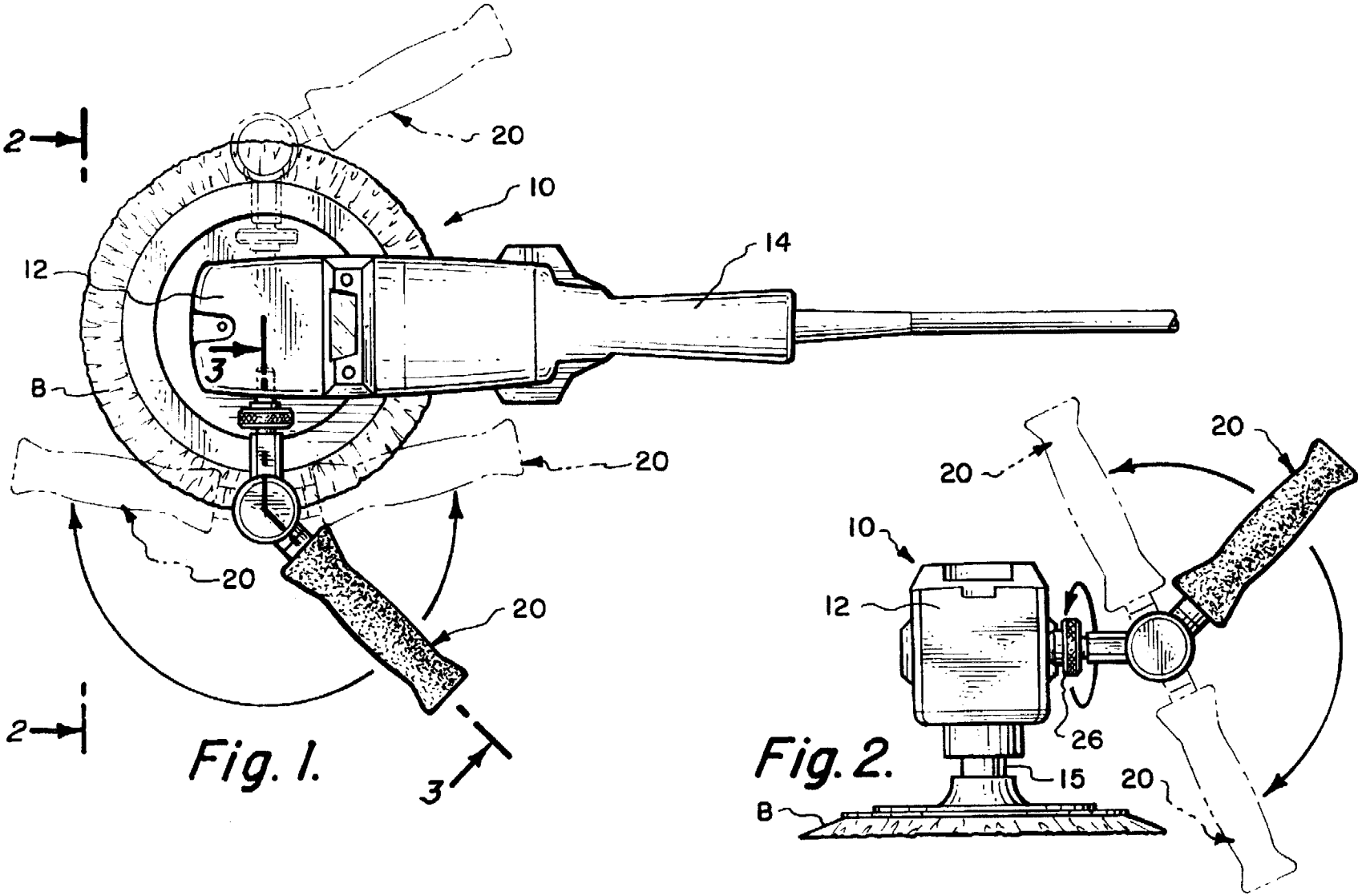
FIGS. 1 through 4 show the mechanism of my new auto body buffing/grinding machine with its novel handle that is angularly adjustable to different fixed positions.

Turning now to the drawings, FIG. 1 is a top plan view of my new auto buffing/grinding machine with a novel adjustable auxiliary handle 20 in addition to the conventional fixed main handle. The machine as a whole, which is designated by numeral 10, has a housing 12 and a main handle 14 secured to the housing. My novel auxiliary handle designated by numeral 20 is shown as being attached to the left side of the machine, but dotted lines also indicate that the auxiliary handle may instead be attached to the right side of the machine.

FIG. 2 is a side elevation view showing the machine 10 with housing 12 and downwardly extending shaft 15 driving a buffing pad B. As shown in FIG. 2, my auxiliary handle 20 may be rotated in a vertical plane between a downwardly extending position, and an upwardly extending position.

Figure 3:
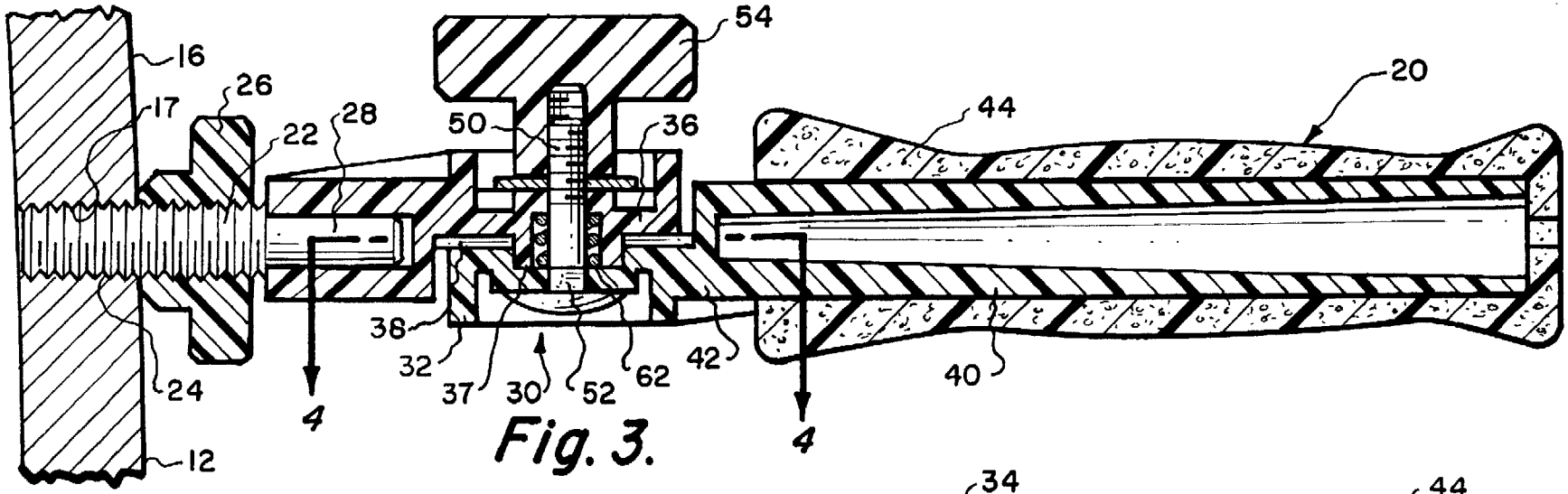
Figure 4:
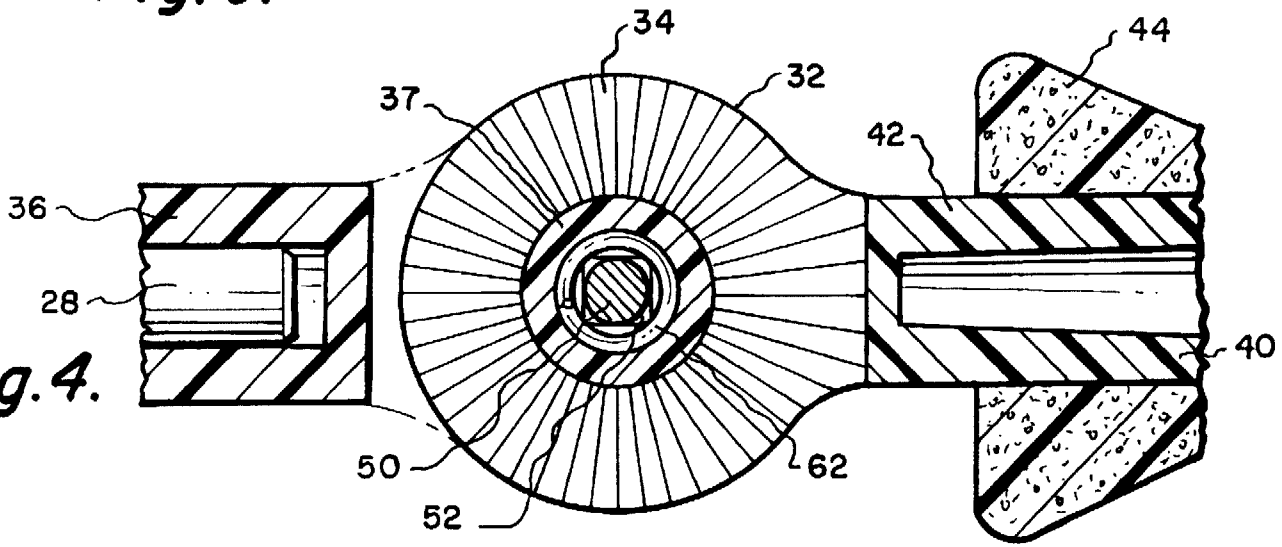

Additional structural details are shown in FIGS. 3 and 4. The housing 12 has a wall 16 in which a threaded opening 17 is formed. An elongated shaft 22 that is part of my novel handle 20 has a threaded forward end 24 that is inserted into the opening 17. A hand operable nut 26 is carried on the attachment shaft 22 and is tightenable against the housing surface 16, so that the rotational position of the attachment shaft relative to the housing may be adjusted and the nut may then be tightened to secure the attachment shaft in its rotationally adjusted position. As best seen in FIG. 2, the hand nut 26 is provided with a knurled surface for convenient operation.

A pivot joint 30 includes a first or lower plate 32 as shown in FIG. 3, and a second or upper plate 36. The upper plate 36 has a lateral end portion with a cylindrical opening that receives a cylindrical rearward end portion 28 of the attachment shaft 22. This joint is press-fitted and preferably also welded, since it may carry a heavy twisting moment.

The lower plate 32 of the pivot joint 30 has a toughened top surface 34, as best seen in FIG. 4. In similar fashion, the upper plate 36 of the pivot joint 30 has a roughened bottom surface 38, shown only in FIG. 3, which faces downward toward the surface 34. When these two roughened surfaces are pressed together the pivot joint is locked in position.

Also included in the pivot joint 30 are a central shaft 50, whose threaded end faces upward as shown in FIG. 3, and a hand operable nut 54 on the upper end of that central shaft. Each of the plates 32, 36, has a central opening through which the central shaft 50 passes. When hand operable nut 54 is tightened on shaft 50, the two plates 36 and 32 of the pivot joint 30 are pushed together into their locked position.

Central shaft 50 is formed as a bolt having a conventional flat head together with a square sub-head 52. As shown in FIG. 4, the square sub-head 52 is received in a square opening in the lower plate 32, which secures the bolt against turning. Upper plate 36 has a downwardly depending portion 37 in which the central opening is recessed on its bottom end, being occupied by a coil spring 62. The central opening in lower plate 32 is recessed on the upper surface of the plate to receive downwardly depending portion 37 of upper plate 36 in rotatable relation therewith. When hand nut 54 is loosened, the spring 62 causes the roughened surfaces of the two plates 32, 36, to separate, so that the pivot joint may be readjusted to a different rotational position.

The auxiliary handle 20 includes a tubular member 40 having a forward end 42 that is fixedly connected to the first or lower plate 32. Around the tubular member there is a resilient hand grip member 44.

Thus the pivot joint 30 supports the plates 32, 36, in rotatable relation to each other so as to change the angular relation between the hand grip member 44 and the attachment shaft 22. The bolt 50 and hand nut 54 provide a locking means for securing the pivot joint in a desired position of adjustment, the roughened surfaces of the plates then providing a secure support for imparting forces of a multidirectional nature to the housing of the machine.

METHOD OF OPERATION

Figure 6:
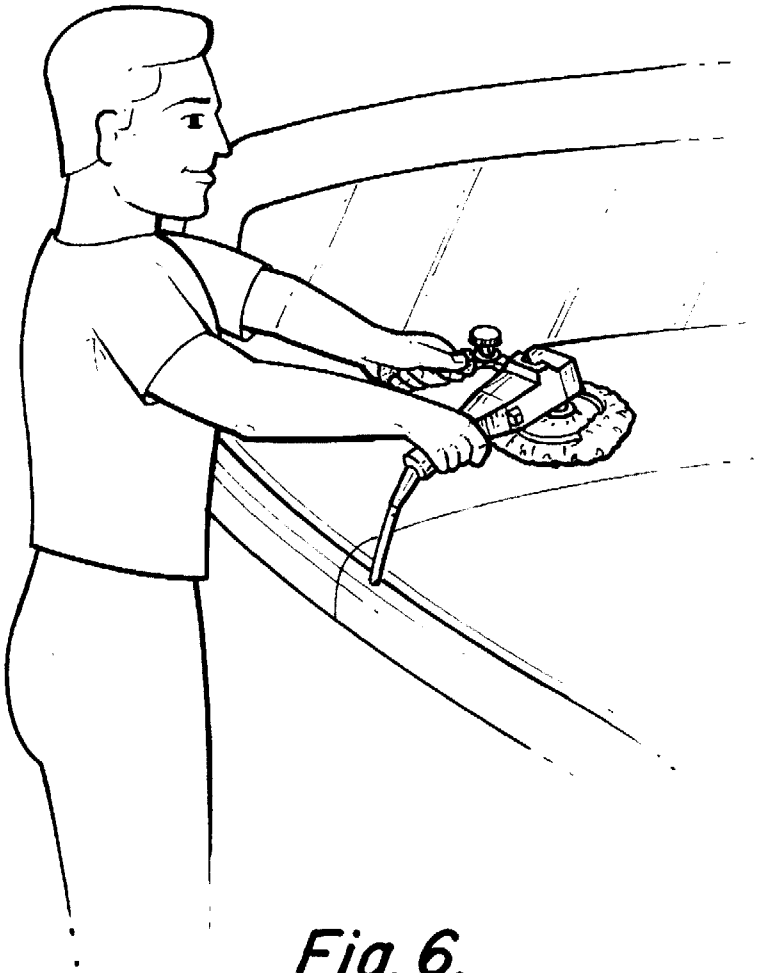
Figure 5:
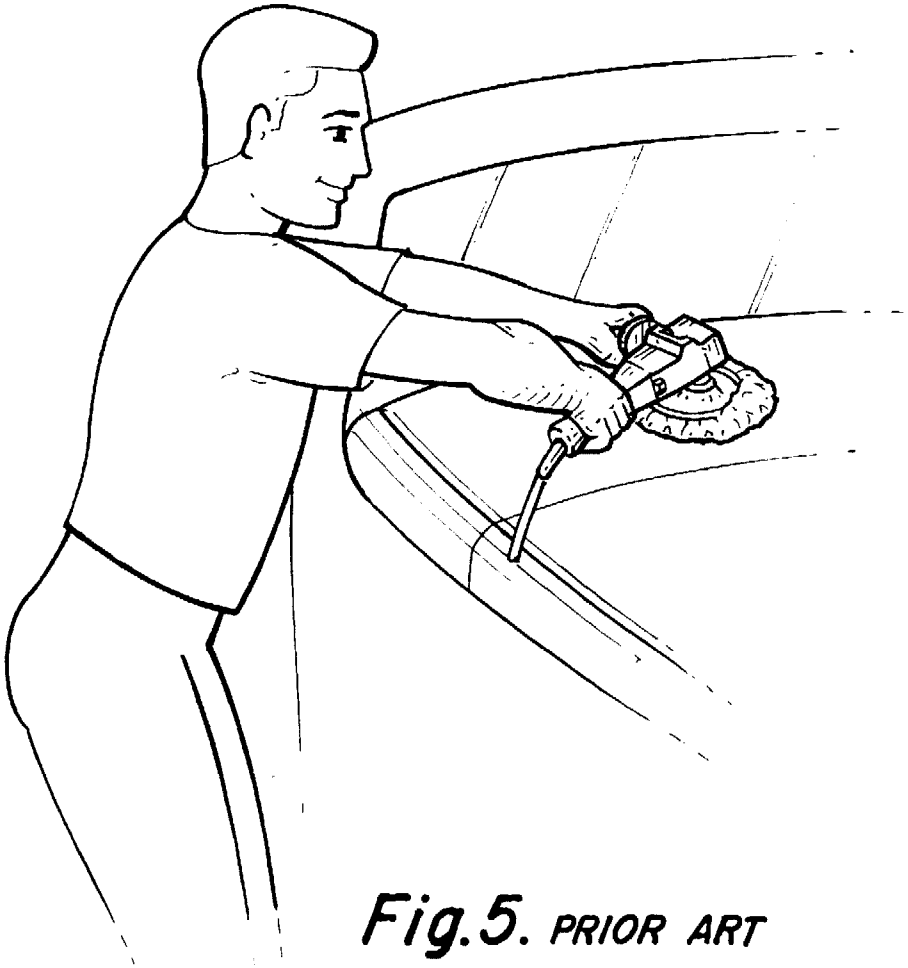
Fig. 5. PRIOR ART

FIGS. 5 and 6 show the operation when making an extended reach to work on top and side surfaces. The traditional grip as shown in FIG. 5 requires the left shoulder and elbow to be extended forward, allowing the posture of the operator's back to be compromised. The arms are thus bent away from one another, and the elbows thrust outwardly, creating a diamond shape. By contrast, in FIG. 6, with the new handle, the extended appendage is able to be swept back towards the operator, allowing a more natural grip at the wrist. The arms are now parallel and the back is straight. Extended reach is gained by the swept-back position as well.

Figure 8:
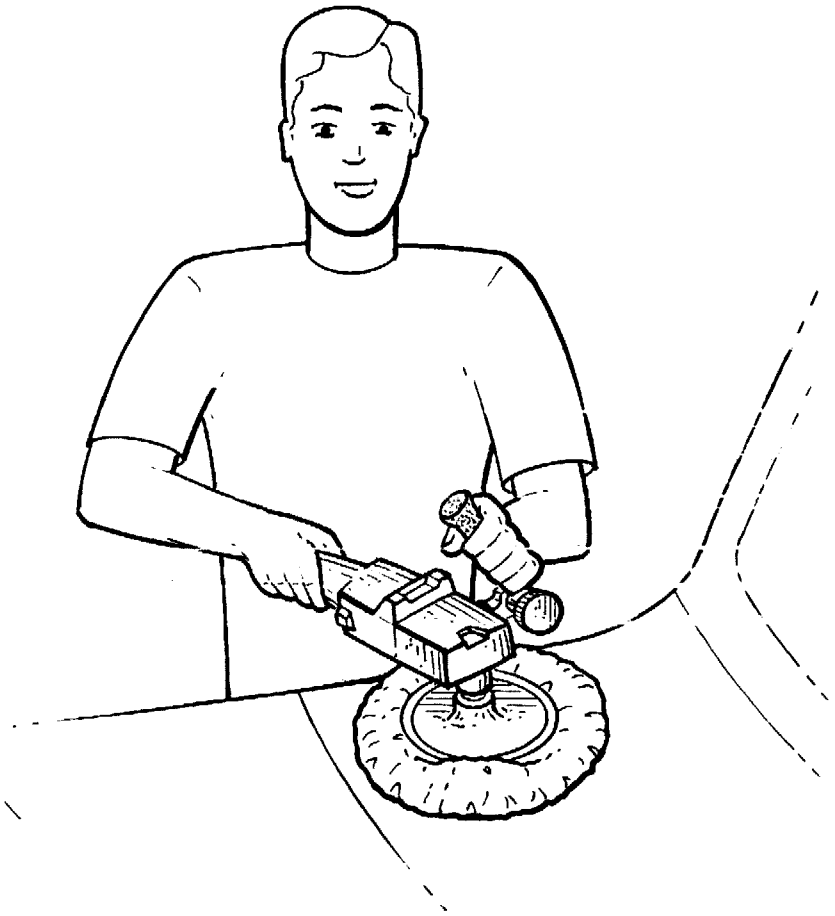
Figure 7:
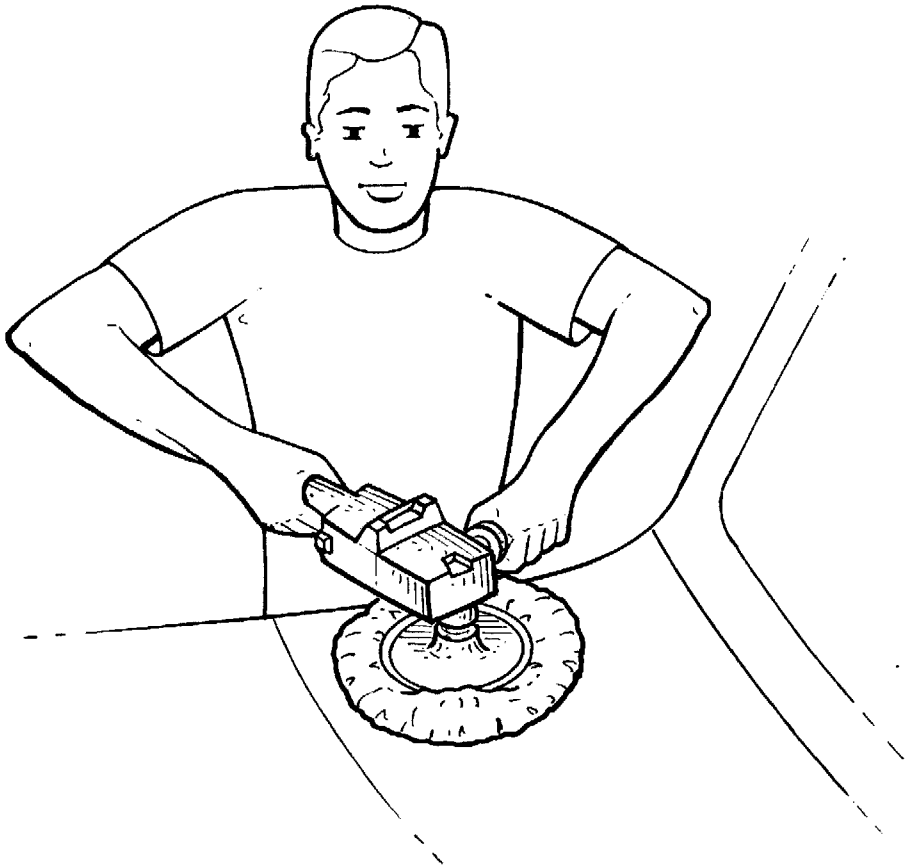
Fig. 7. PRIOR ART

FIGS. 7 and 8 illustrate work on the top and side surfaces at close range. The traditional grip as shown in FIG. 7 requires the left and right shoulders of the operator to be raised up and the elbows thrust outward to create a diamond shape between the arms. The left wrist must apply downward pressure to the buffer, creating pain and fatigue to the wrist. The operator's back is also bent forward over the work. By contrast, as shown in FIG. 8, my novel adjustable handle may be adjusted to an angular position over the top of the buffer that allows a natural grip. The wrist is now pointing downward. Optimum control and downward pressure is thus achieved. The arms are parallel and down to the sides. The operator's back is straight, allowing maximum stability of body position over the work surface.

Figure 10:
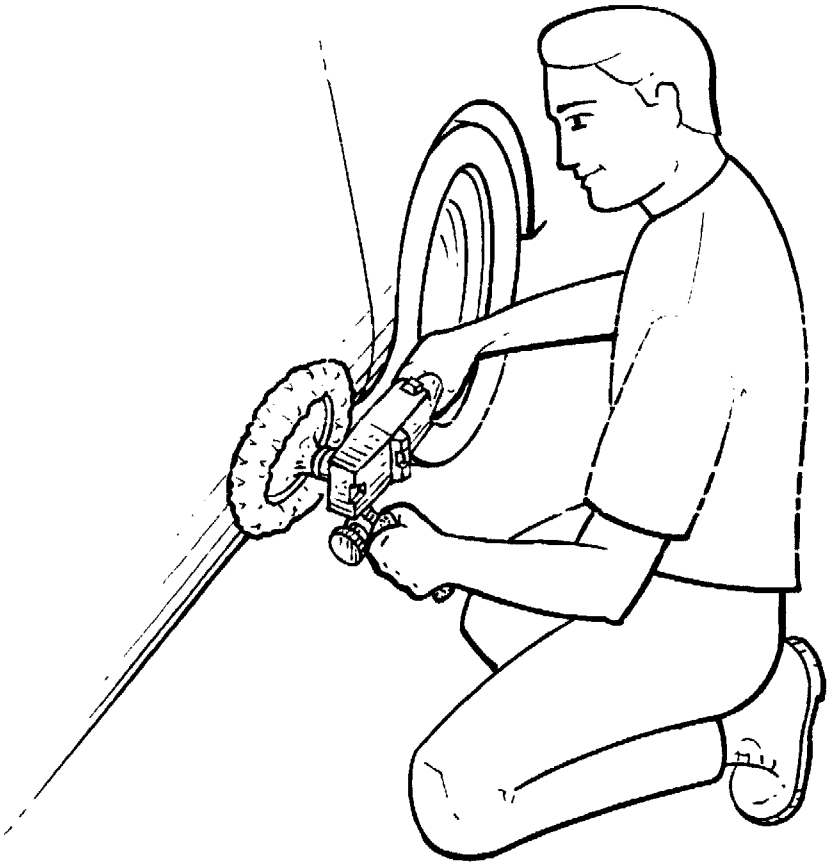
Figure 9:
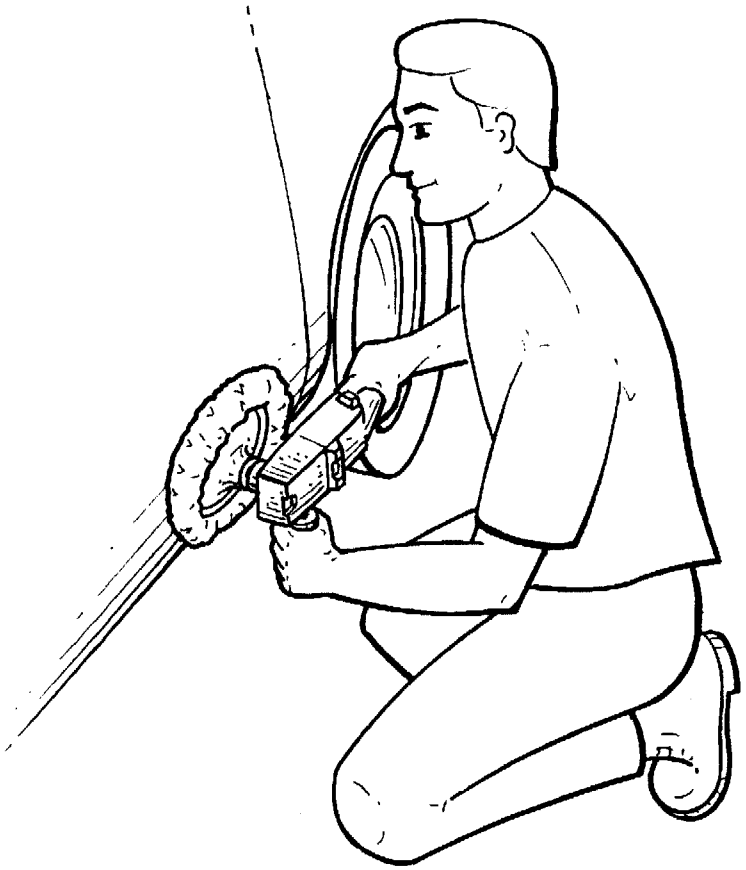
Fig. 9. PRIOR ART

FIGS. 9 and 10 show the buffing of lower side panels and angled lower body surface. As shown in FIG. 9 with the fixed handle pointing downward, the traditional buffer handle adds difficulty to working on the lower surfaces. This requires a most unnatural body position for the operator. The left shoulder is dropped down. The operator's body is bent forward. The buffer tends to pull the operator around toward the work surface. By contrast, my new handle as shown in FIG. 10 is adjustable to enable a natural grip from 60 to 90 degrees over the head of the buffer. This allows the operator to guide the buffer with greater control. The position of the left shoulder is correct and the operator's posture is straight.

Figure 12:
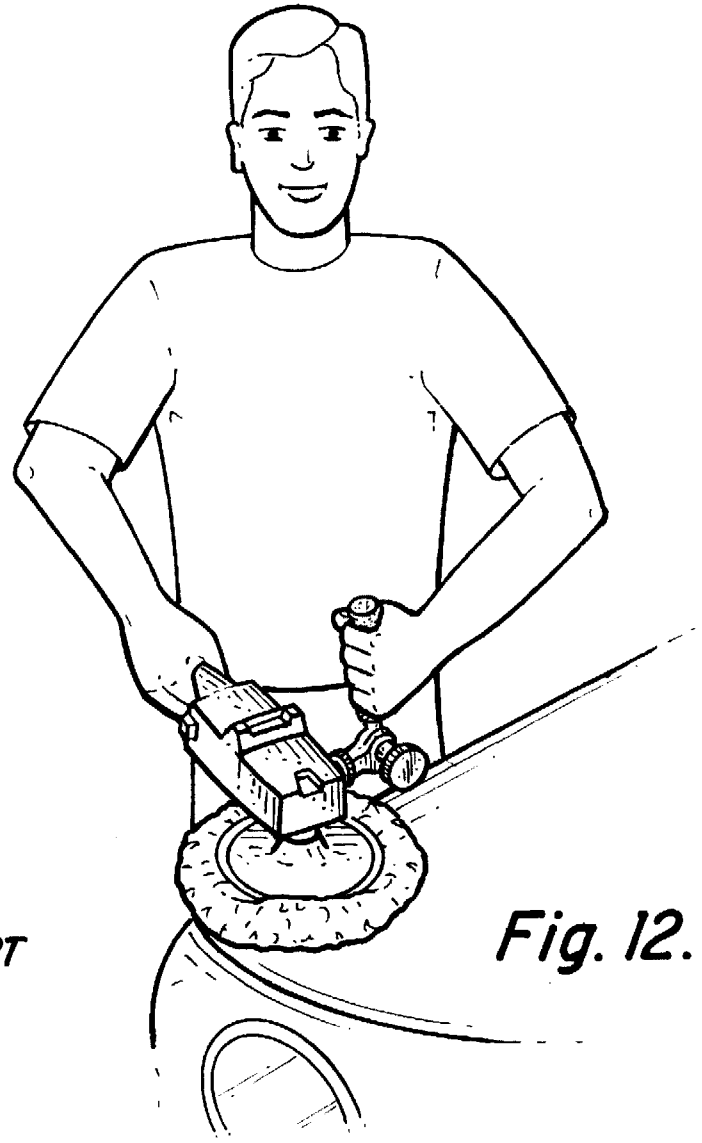
Figure 11:
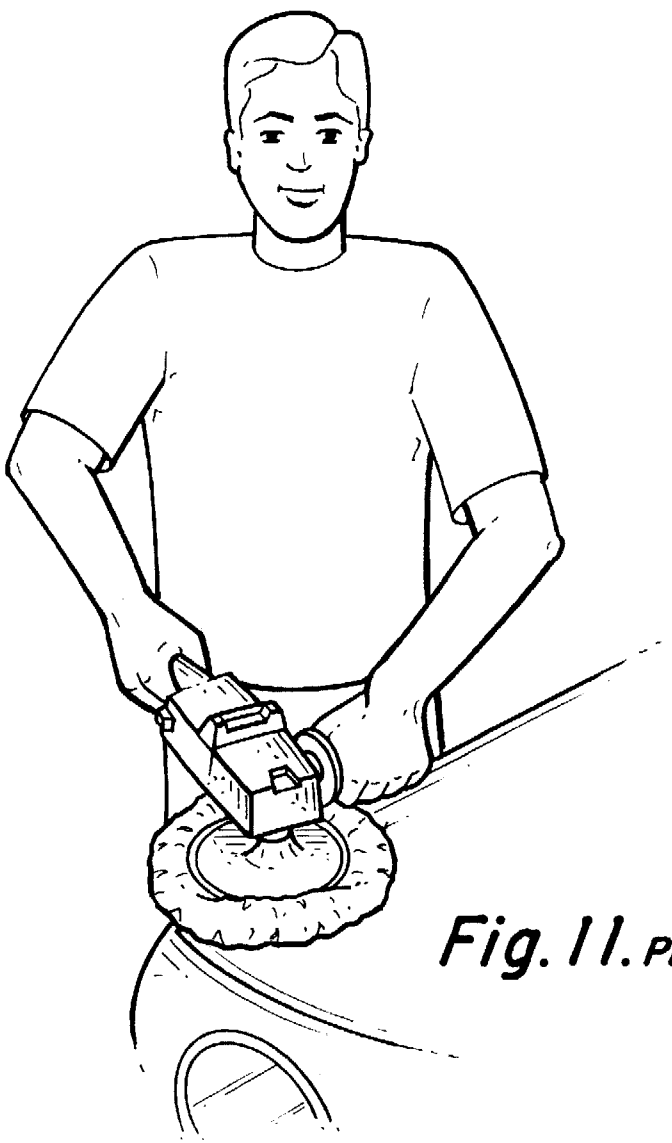
Fig. 11. PRIOR ART

FIGS. 11 and 12 again show work on the upper surface of the auto body, namely, the hood above a headlight. As shown in FIG. 11 the traditional grip requires all downward pressure to be applied through the left wrist. The operator's back is bent forward over the work area. As a result, fatigue is increased. This traditional position lacks control against counter steering of the buffer. By contrast, as shown in FIG. 12 my new handle may be turned 90 degrees upward for an upward grip, resulting in a more natural hand and wrist position. There is less body fatigure and greater control against counter steering of the buffer machine.

It will be understood that a number of modifications may be made within the scope of my invention. For example, the threaded forward end 24 of elongated attachment shaft 22 that is inserted into the opening 17 may be entirely fixed, and a rotating joint with parallel roughened plates may be attached to the upper end of the shaft that will lock the plate 32 in a selected position.

While the presently preferred form of the invention has been disclosed in detail in order to comply with the patent laws, it will nevertheless be understood that the scope of the invention is to be determined only in accordance with the appended claims.

What I claim is:

1. An auto body buffing/grinding machine comprising a housing, a main handle fixedly secured to the housing, a threaded opening in the housing, an auxiliary handle supportable from the threaded opening and that is angularly adjustable by more than ninety degree to different fixed positions, and that also includes manually operated locking means for locking the auxiliary handle in a desired angular position.

2. An auxiliary handle mechanism as in claim 1, comprising:

an elongated attachment shaft having a threaded forward end that is adapted to be inserted into the threaded opening;

a first hand operable nut on the elongated attachment shaft that is tightenable against the housing, so that the rotational position of said attachment shaft relative to the housing may be adjusted and said nut may then be tightened to secure said attachment shaft in its rotationally adjusted position;

a pivot joint including first and second plates disposed in parallel relation and each having a roughened surface facing toward the other plate;

an elongated hand grip having a forward end fixedly connected to said first plate;

said attachment shaft having a rearward end fixedly connected to said second plate, the plane of said second plate being parallel to the axis of said attachment shaft;

said pivot joint having a central shaft supporting said plates in pivotal relation to each other so as to change the angular relation of said hand grip to said attachment shaft;

locking means for securing said pivot joint in a desired position of adjustment, said roughened surfaces of said plates then providing a secure support for imparting forces of a multi-directional nature to the housing; and said locking means including spring means disposed between said plates for normally keeping said plates separated so that their relative positions may be adjusted, and a second hand operable nut on said central shaft for tightening said toughened surfaces of said plates together against the force of said spring means.

3. An auto body buffing/grinding machine as in claim 1 wherein said auxiliary handle contains two separate adjustment mechanisms, and a separate manually operated locking means for locking each of said adjustment mechanisms so as to secure the handle in a desired position of adjustment.

4. An adjustable handle mechanism for supporting a body that has a threaded opening, which is quickly and easily attachable to the body, quickly and easily adjustable, and easily detachable from the body, the handle mechanism comprising:

an elongated threaded shaft carrying a first hand operable nut, and having a threaded forward end projecting beyond the first hand operable nut and adapted to be inserted into the threaded opening of the body so that the rotational position of the elongated shaft relative to the body may be adjusted, and the first hand operable nut may then be tightened against the body to secure the elongated shaft in its rotationally adjusted position;

an elongated rigid hand grip;

first and second plates disposed in parallel relation and having mutually facing roughened surfaces lying in a plane that is parallel to both the longitudinal axis of the hand grip and the longitudinal axis of the elongated shaft;

the elongated rigid hand grip having a forward end fixedly connected to the first plate, and the elongated shaft having a rearward end fixedly connected to the second plate;

a central shaft supporting the plates in pivotal relation to each other to form a pivot joint so as to adjust the angular relation between the longitudinal axis of the hand grip and the longitudinal axis of the elongated shaft;

locking means for securing the pivot joint in a desired position of adjustment, the roughened surfaces of the plates then providing a secure support for imparting multi-directional forces from the hand grip to the body; and the locking means including spring means normally urging the plates apart so that their relative positions may be adjusted, and a second hand operable nut on the central shaft for tightening the roughened surfaces of the plates together against the force of the spring means.

5. An adjustable handle mechanism as in claim 4 wherein the spring means is disposed between the plates.

6. An adjustable handle mechanism as in claim 4 wherein the longitudinal axes of both the hand grip and the elongated shaft substantially coincide with the plane of the mutually facing surfaces of the plates.

7. An adjustable handle mechanism as in claim 4 wherein the arrangement of parts is such that the longitudinal axis of the hand grip may be bent more than ninety degrees relative to the longitudinal axis of the elongated shaft.

8. An auto body buffing machine comprising a housing, a main handle fixedly secured to the housing, a threaded opening in the housing for attachment of an auxiliary handle, and an auxiliary handle which is quickly and easily attachable to the housing, quickly and easily adjustable to various fixed positions, and easily detachable from the housing, the auxiliary handle mechanism comprising:

an elongated threaded shaft carrying a first hand operable nut, and having a threaded forward end projecting beyond the first hand operable nut and adapted to be inserted into the threaded opening of the housing so that the rotational position of the elongated shaft relative to the housing may be adjusted, and the first hand operable nut may then be tightened against the housing to fixedly secure the elongated shaft in its rotationally adjusted position;

an elongated rigid hand grip;

first and second plates disposed in parallel relation and having mutually facing roughened surfaces lying in a plane that substantially coincides with both the longitudinal axis of the hand grip and the longitudinal axis of the elongated shaft;

the elongated rigid hand grip having a forward end fixedly connected to the first plate, and the elongated shaft having a rearward end fixedly connected to the second plate;

a central shaft supporting the plates in pivotal relation to each other to form a pivot joint for adjusting the angular relation between the longitudinal axis of the hand grip and the longitudinal axis of the elongated shaft, the arrangement of parts being such that the longitudinal axis of the hand grip may be bent more than ninety degrees relative to the longitudinal axis of the elongated shaft;

locking means for securing the pivot joint in a desired position of adjustment, the roughened surfaces of the plates then providing a secure support for imparting multi-directional forces from the hand grip to the body; and the locking means including spring means between the plates normally urging the plates apart so that their relative rotational positions may be easily adjusted, and a second hand operable nut on the central shaft for tightening the roughened surfaces of the plates together against the force of the spring means.

* * * * *